US006294719B1

(12) United States Patent
Palecki et al.

(10) Patent No.: US 6,294,719 B1
(45) Date of Patent: Sep. 25, 2001

(54) MUSICAL INSTRUMENT STRING WINDER

(76) Inventors: Thomas L. Palecki, 1039-E Serpentine La., Pleasanton, CA (US) 94566; David R. Jeffrey, 216 Watson Dr. #4, Campbell, CA (US) 95008

( * ) Notice: Subject to any disclaimer, the term of this patent is extended or adjusted under 35 U.S.C. 154(b) by 0 days.

(21) Appl. No.: 09/420,994

(22) Filed: Oct. 20, 1999

Related U.S. Application Data

(60) Provisional application No. 60/105,003, filed on Oct. 20, 1998.

(51) Int. Cl.[7] ..... G10G 7/00

(52) U.S. Cl. ..... 84/458; 84/453; 84/454; 81/124.2; 81/177.85

(58) Field of Search ..... 84/458, 304, 453, 84/454; 81/124.2, 124.4, 177.85

(56) References Cited

U.S. PATENT DOCUMENTS

| | | | | |
|---|---|---|---|---|
| D. 393,578 | * | 4/1998 | Keddie | D8/17 |
| 3,706,254 | * | 12/1972 | Morin | 84/458 |
| 4,278,002 | | 7/1981 | Siminoff | 84/304 |
| 4,357,845 | * | 11/1982 | Cornia | 81/125 |
| 4,791,849 | | 12/1988 | Kelley | 84/458 |
| 4,817,475 | * | 4/1989 | Kelly et al. | 81/121.1 |
| 5,272,953 | | 12/1993 | Koch | 84/458 |
| 5,410,939 | * | 5/1995 | Matamoros et al. | 84/458 |
| 5,697,268 | * | 12/1997 | Makovsky et al. | 81/125 |

FOREIGN PATENT DOCUMENTS

| | | | |
|---|---|---|---|
| 2322824 | 11/1974 | (DE) | G10D/3/00 |
| 8716264 | 2/1988 | (DE) | G01D/3/00 |
| 9244631 | 9/1997 | (JP) | G10D/3/14 |

* cited by examiner

*Primary Examiner*—Shih-Yung Hsieh
(74) *Attorney, Agent, or Firm*—Carol D. Titus; James J. Leary

(57) ABSTRACT

A string winding device for winding and unwinding the string on a peg of a stringed instrument has a generally cylindrical body with a slot extending inward from one end thereof. The slot has a plurality of sections, which are configured to engage different size and shape pegs on stringed instruments. The slot has a shallow and wide section, a deep and narrow section and a middle section of medium depth and width. A fourth section is located perpendicular to the other three sections and is configured for specialty tuning pegs. Extending from the top of the string winder body is a hexagonal shaft for engagement with a cordless screwdriver, drill or one of the hubs or cranks disclosed herein. A manual hub or crank with a handle may be used to turn the string winder body. The hub of the crank for the manual hub may utilize a flexible tab within the hub to interlock with a recess in the hexagonal shaft to hold the parts together during use. The crank has a lever arm attached to the hub and a handle attached to the opposite end of the lever arm. A user may hold the handle and rotate the lever arm clockwise or counter-clockwise in order to tighten or loose the string of the instrument. An alternate handle design also has a notch with an angled surface located in the upper perimeter of the handle. The notch is used for removing the string retainer peg or pin on acoustic guitars.

21 Claims, 8 Drawing Sheets

FIGURE: 3
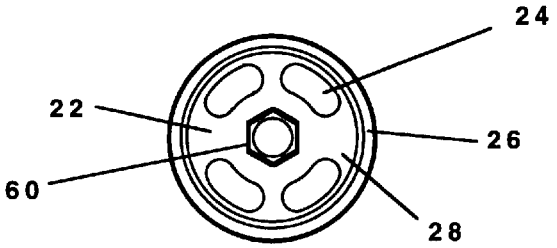
FIGURE: 4
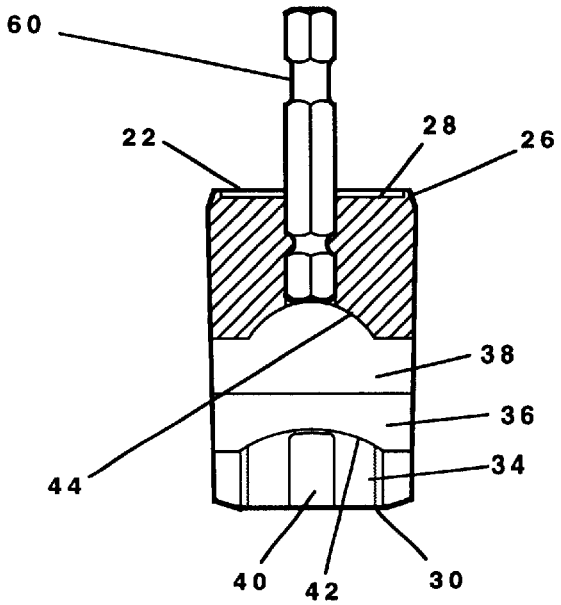
FIGURE: 5
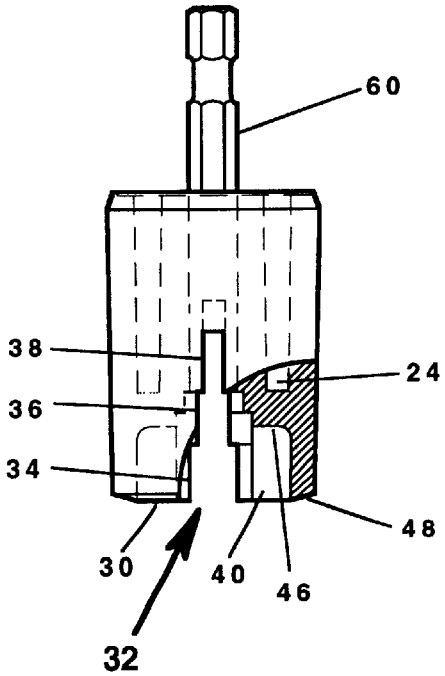
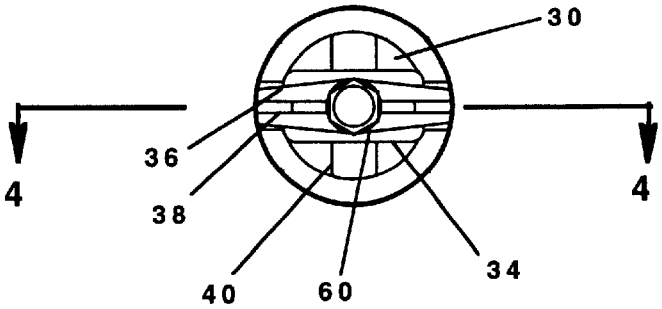
FIGURE: 6

MUSICAL INSTRUMENT STRING WINDER

CROSS REFERENCE TO OTHER APPLICATIONS

This application claims the benefit of U.S. Provisional Patent Application No. 60/105,003, filed Oct. 20, 1998.

FIELD OF THE INVENTION

The present invention relates to devices for winding strings. More particularly, it relates to a device for winding and unwinding strings on tuning pegs of musical instruments.

BACKGROUND OF THE INVENTION

When replacing the strings on stringed instruments, the pegs that tighten the strings must be rotated many times in one direction to unwind the string to remove it. Then, once a new string is in place, the peg must be rotated many times in the opposite direction to re-wind the string onto the peg to tighten it. The unwinding and re-winding is both time-consuming and potentially injurious to the person replacing the string. The motions associated with the process may be damaging the wrist of the user causing a repetitive strain injury such as carpal tunnel syndrome.

There are several devices that have been designed to aid a user when tuning a string or winding a string. However, the designs for tuning a string are complicated devices, which monitor the vibration of the string and automatically provide minor adjustments to the peg to alter the frequency of the string. Both the tuning devices and the winding device also suffer from a limited range of use. Typically, the member for engaging the peg is usable only for a certain type of peg. If other styles of pegs are used, the devices are either clumsy or completely ineffective.

Therefore, there is a dear need in the industry for a device that allows a user to quickly and easily wind and unwind a string from any style of peg of a musical instrument.

SUMMARY OF THE INVENTION

In keeping with the foregoing discussion, the present invention takes the form of a string winding device having a generally circular body with a slot extending inward from one end. The slot has a plurality of sections, each of which are configured to engage different size and shape pegs on stringed instruments. The slot has a shallow and wide section, a deep and narrow section and a middle section of medium depth and width. A fourth section is located perpendicular to the other three sections and is configured for specialty tuning pegs. Extending from the top of the string winder body is a hexagonal shaft for engagement with a cordless screwdriver, drill or one of the hubs or cranks disclosed herein.

A manual hub or crank with a handle may be used to turn the string winder body. The hub of the crank and the manual hub may each utilize a flexible tab within the hub to interlock with a recess in the hexagonal shaft to hold the parts together during use. The crank also has a lever arm attached to the hub and a rotating handle attached to the opposite end of the lever arm. A user may hold the handle and rotate the lever arm clockwise or counter-clockwise in order to tighten or loose the string on the peg of the instrument.

BRIEF DESCRIPTION OF THE DRAWINGS

FIG. 3 is a top view of the string winding device.

FIG. 4 is a cross-sectional view of the string winding device.

FIG. 5 is a side, partial cut-away view of the string winding device.

FIG. 6 is a bottom view of the string winding device.

DETAILED DESCRIPTION

Figure 1:
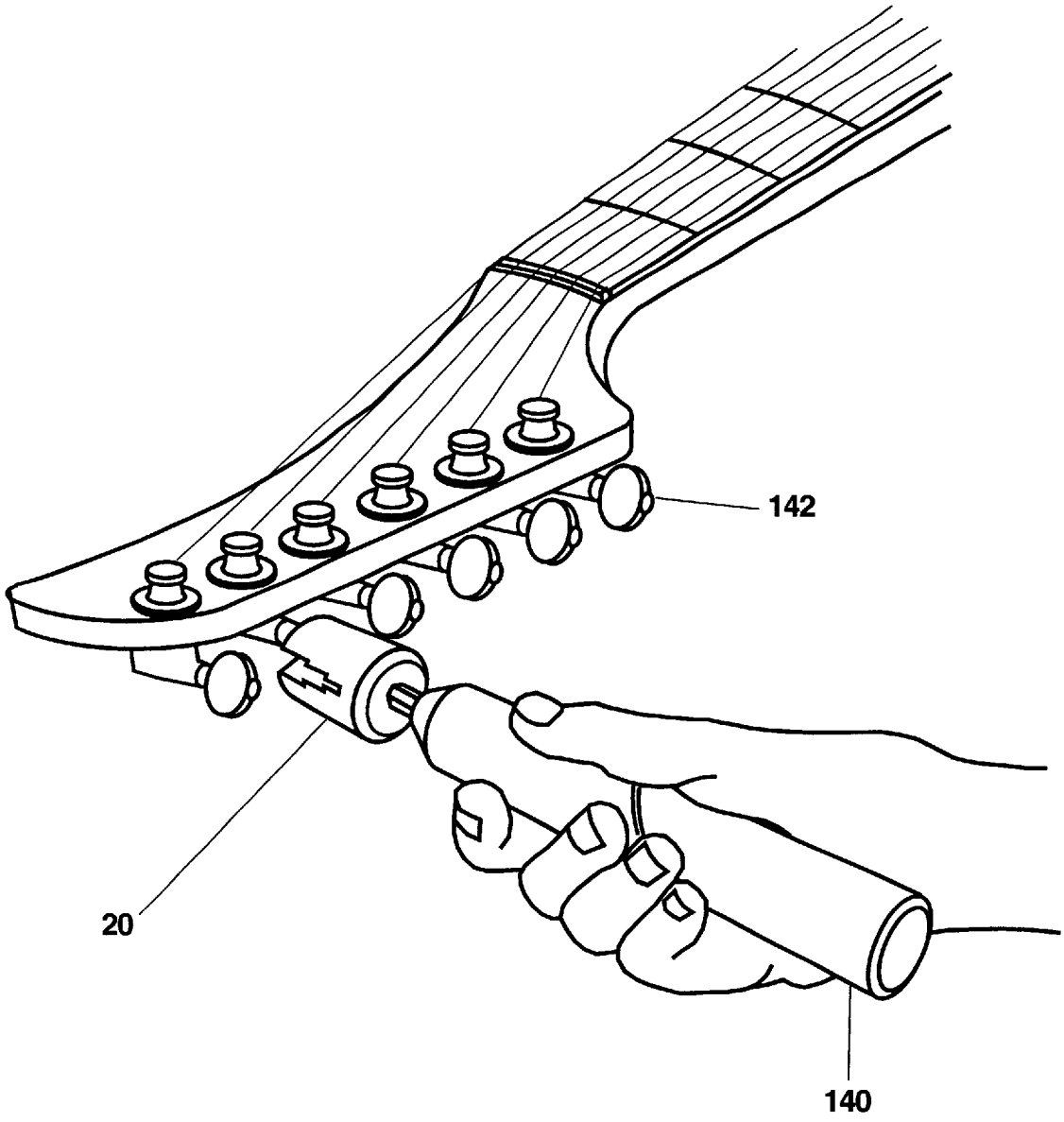
FIG. 1 is a perspective view of the string winding device in use.
Figure 2:
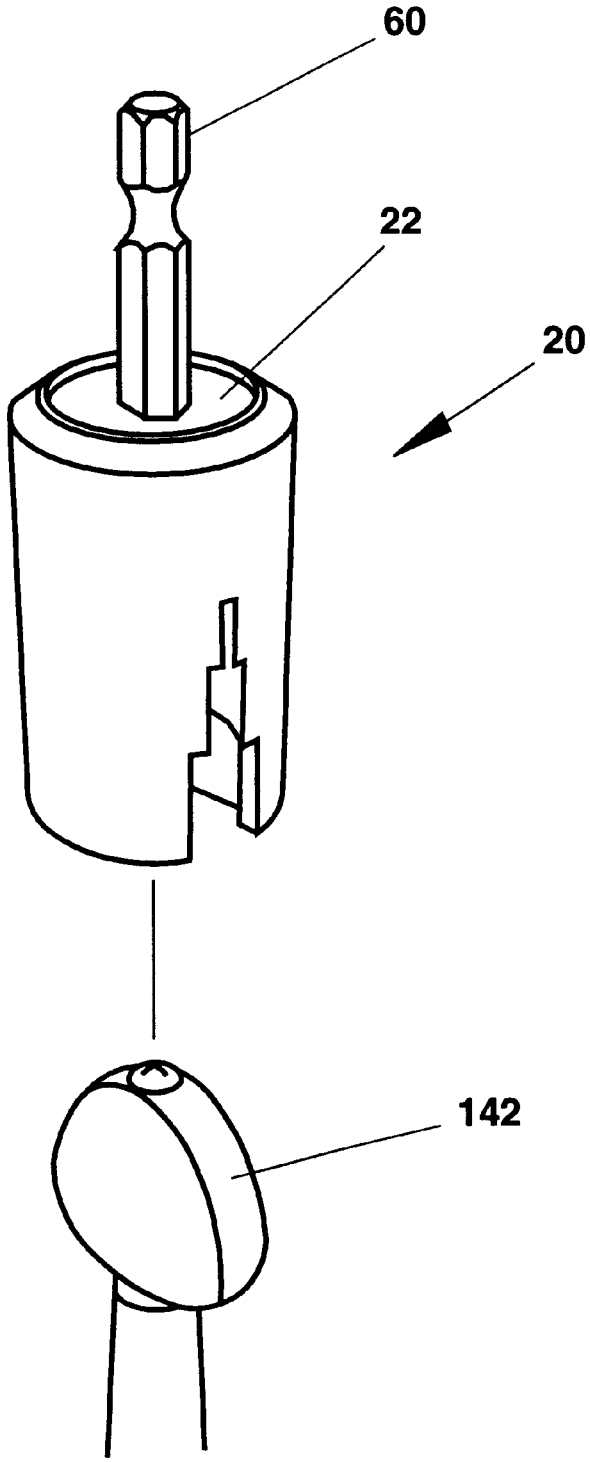
FIG. 2 is close-up perspective view of the string winding device descending over a standard guitar tuning peg.

FIG. 1 is a perspective view of the string winding device 20 used with a cordless screwdriver 140 to engage a tuning peg 142 to wind a string. FIG. 2 is close-up perspective view of the string winding device 20 descending over a standard tuning peg 142. The body 20 of the string winder is generally cylindrical and may be slightly tapered toward the bottom end 30. The ends 22, 30 of the string winder 20 are generally flat with optional bevels 26, 48 between the sidewall and the top surface 22 and bottom surface 30. Depending on the configuration of the pegs 142 of musical instrument, the size of the body 20 may vary. However, the body 20 is preferably in the range of 0.5 to 3.0 inches long, more preferably in the range of 0.75 to 2.5 inches and most preferably in the range of 1.25 to 2.0 inches. In the embodiment shown, the length of the body 20 is approximately 1.6 inches. The diameter of the body 20 is preferably in the range of 0.5 to 2.0 inches, more preferably in the range of 0.75 to 1.5 inches, most preferably in the range of 0.8 to 1.25 inches. In the embodiment shown, the body 20 is approximately 1.05 inches in diameter. Overall, the diameter of the body 20 should be chosen such that the string winder body 20 may freely rotated when located over a peg 142 on an instrument. For some instruments this can be very important, such as for the 12-string guitar, which has very little clearance between the pegs.

FIG. 3 is a top view of the string winding device 20. The top end 22 of the body 20 may be integrally formed with a hexagonal shaft 60 partially embedded in the body 20 and extending therefrom. Optionally, the top end 22 has a recess 28 for placement of a graphic label. The recess 28 may be adjusted depending on the desire of the user as well as the depth of the label applied. The recess 28 is preferably between 0.01 and 0.10 inches, more preferably between 0.01 and 0.07, most preferably between 0.02 and 0.05. In the embodiment shown, the recess 28 is approximately 0.03. The recess 28 also provides a nesting place for the bottom end of a hand crank accessory discussed later. Another optional feature is a set of holes 24 extending down from the top end 22 and from the recess 28, if present. These optional holes 24 are sized and configured to provide approximately equal wall thickness throughout the body 20, thereby creating a design that is easily and effectively injection molded.

Figure 7:
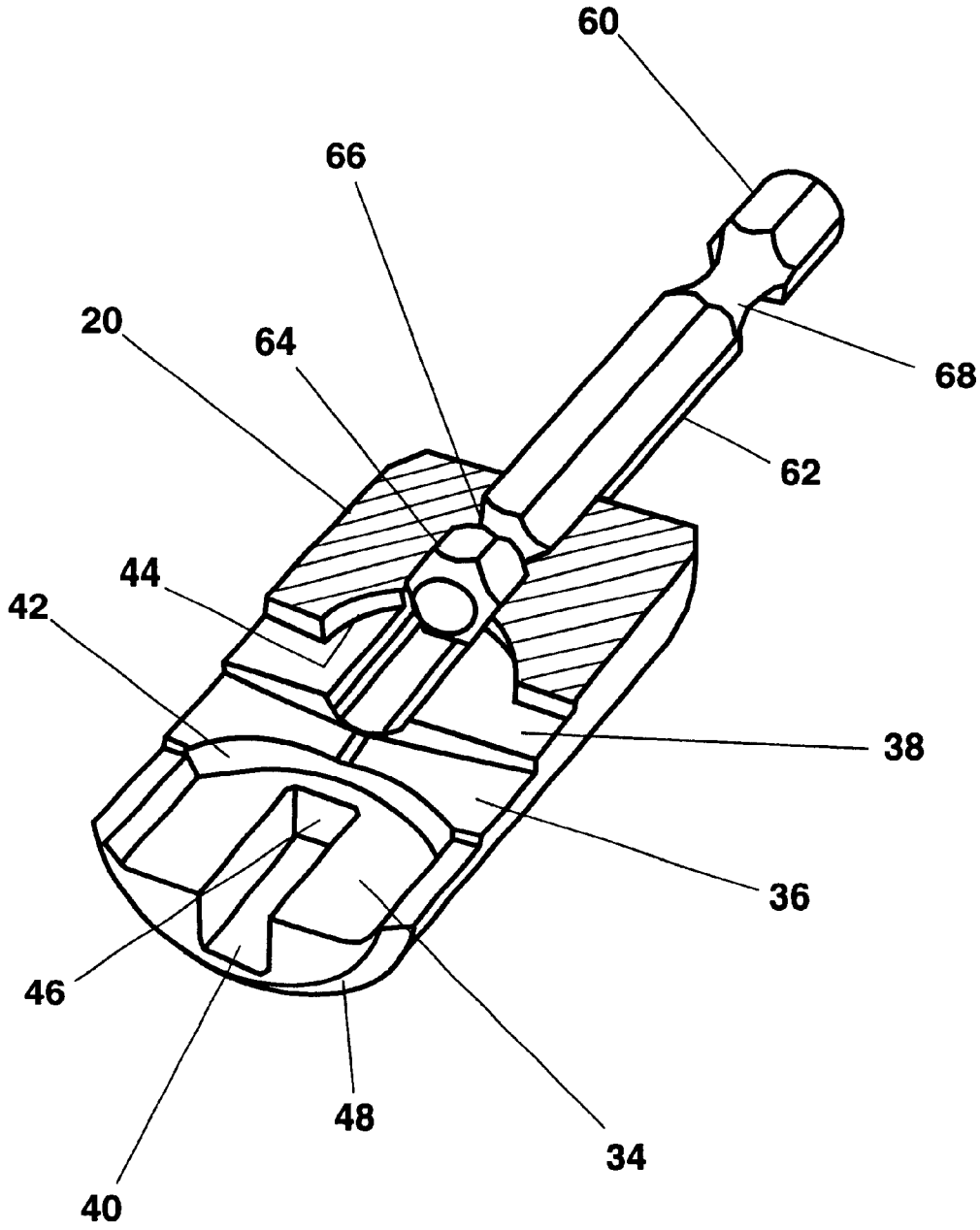
FIG. 7 is perspective, cut-away view of the string winding device.

FIG. 4 is a cross-sectional view and FIG. 5 a side, partial cut-away view of the string winding device 20. FIG. 6 is a bottom view of the string winding device 20, and FIG. 7 is perspective, cut-away view. The bottom end 30 of the body 20 has a slot 32 having a plurality of differently configured sections for engagement with different tuning pegs 142. In the embodiment shown, the slot 20 has two steps forming three different sections 34, 36, 38 each having a different width. A fourth section 40 is located approximately perpendicular to the other sections 34, 36, 38. Each section 34, 36, 38, 40 of the slot 32 is specially contoured to fit one, or a variety of styles of tuning pegs 142, for example pegs on a 6-string style or bass style guitar. The fourth section 40 is designed to fit a specific vintage tuning peg. The first three contiguous sections 34, 36, 38 of the slot 20 extend the full width of the body 20 and create a stepped opening extending upward on opposite sides of the sidewall of the body 20.

The lower section 34 of the slot 32 has a width of approximately 0.25 inches, but may be anywhere in the range of 0.10 to 0.50 inches, preferably in the range of 0.15 to 0.35 inches. The lower section 34 of the slot 32 extends upward from the bottom end 30 of the body 20 approximately 0.30 inches, but may extend anywhere from 0.10 to 0.50 inches from the bottom end 30, preferably between 0.20 and 0.40 inches. The center portion of the lower section 34 of the slot 32 has a radius of curvature of approximately 0.625 inches creating a depression 42 with a depth of approximately 0.15 inches at the center, however the radius of curvature may range from 0.40 to 0.80 inches, thereby altering the depth of the depression 42.

The middle section 36 of the slot 32 has a width of approximately 0.15 inches, but may be anywhere in the range of 0.08 to 0.25 inches, preferably in the range of 0.10 to 0.20 inches. At the perimeter of the body 20, the middle section 36 extends from the top end of the lower section 34 of the slot 32 to approximately 0.60 inches from the bottom end 30 of the body 20, but may extend anywhere from 0.20 to 1.00 inches from the bottom end 30, preferably between 0.50 and 0.70 inches.

The upper section 38 of the slot 32 has a width of approximately 0.09 inches, but may be anywhere from 0.07 to 0.12, more preferably between 0.08 and 0.10 inches. At the perimeter of the body 20, the upper section 38 of the slot 32 extends from the top of the middle section 36 of the slot 32 to approximately 0.9 inches from the bottom end 30 of the body 20, but may extend anywhere from 0.3 to 1.5 inches from the bottom end 30, more preferably between 0.8 to 1.0 inches. The center portion of the top surface of the upper section 38 of the slot 32 has a curvature of approximately 0.4 inches creating a depression 44 with a depth of approximately 0.2 inches at the center, however, the radius of curvature may range from 0.2 to 0.6 inches, thereby altering the depth of the depression 44.

The perpendicular section 40 of the slot 32 has a width of approximately 0.25 inches, but may range anywhere from 0.1 to 0.35 inches or other dimensions to fit specially designed pegs 142, more preferably the width is between 0.2 and 0.3 inches. The perpendicular section 40 of the slot 32 extends in from the bottom end 30 of the body 20 to approximately 0.4 inches, but may range anywhere from 0.1 to 1.0 inches, more preferably from 0.3 to 0.5 inches from bottom end 30 of the body 20. The center portion of the upper surface 46 of the perpendicular section 40 has a slope of about ten percent, thereby increasing the depth of the perpendicular section 40 of the slot 32 nearing the center of the body 20. The perpendicular portion 40 of the slot 32 extends across approximately 0.75 inches centered therein, but may extend anywhere from 0.5 inches to the full diameter of the body 20, more preferably between 0.6 and 0.9 inches.

The upper section 38 and middle section 36 of the slot 32 are generally configured to engage bass pegs. The lower section 34 of the slot 32 is generally configured to engage guitar pegs. The perpendicular section 40 of the slot 32 is generally configured to engage specialty guitar pegs. The particular contours of the sections 34, 36, 38, 40 of the slot 32 not only provide engagement with virtually any peg 142 configuration, but also assist in retaining the peg 142 centered within the slot 32 as the peg 142 is being rotated.

The bottom end 30 of the string winder body 20 is also configured to provide a surface on which the body 20 may be rested when the string winder 20 is not in use. In the embodiment shown, the two semi-circular sidewalls provide the resting surface.

Figure 8:
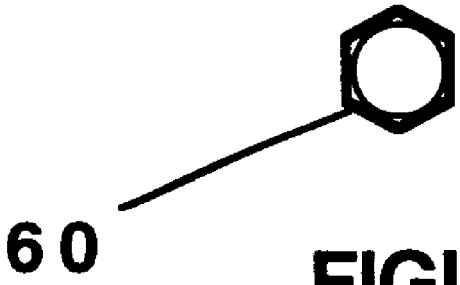
FIG. 8 is an end view of the hex shaft of the string winding device.
Figure 9:
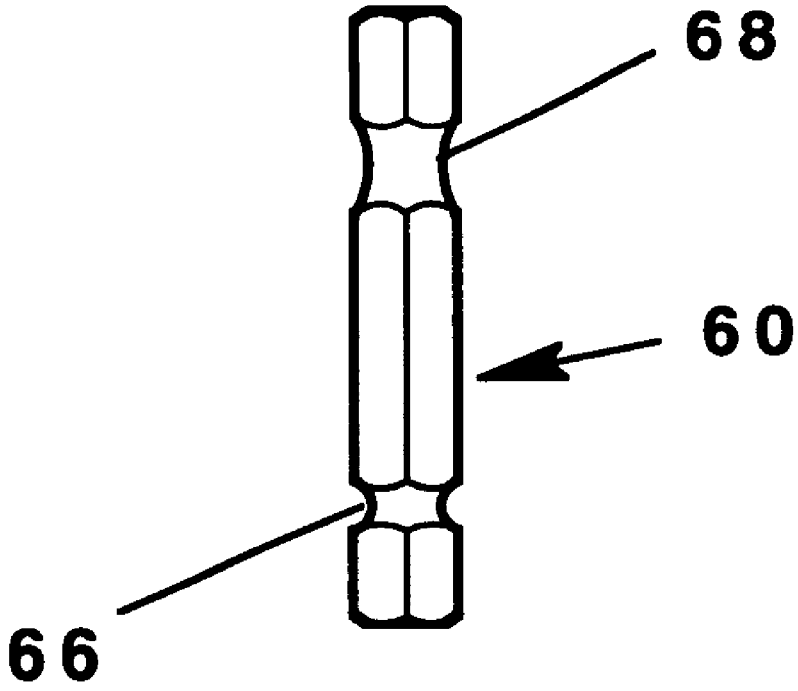
FIG. 9 is a side view of the hex shaft of the string winding device.

FIG. 8 and 9 are end and side views of the hex shaft 60 of the string winding device 20. The hexagonally-shaped shaft 60 preferably has a width in the range of 0.1 to 0.5 inches, more preferably in the range of 0.2 to 0.4 inches, most preferably in the range of 0.2 to 0.3 inches. The embodiment shown has a hex shaft 60 with a width of approximately 0.25. The 0.25 inch width shaft 60 is particularly useful for use with a cordless screwdriver 140, as seen in FIG. 1. The length of the hex shaft 60 is preferably in the range of 0.5 to 3.0 inches, more preferably in the range of 0.75 to 2.5 inches, most preferably in the range of 1.25 to 2.0 inches. In the embodiment shown, the hex shaft 60 is approximately 1.5 inches long. If the shaft 60 is integrally molded with the body 20, the extending length 62 of the shaft is preferably in the range of 0.2 to 2.0 inches, more preferably in the range of 0.5 to 1.8 inches, most preferably in the range of 0.7 to 1.3 inches. In the embodiment shown, the extending length 62 of the hex shaft is approximately 1.0 inch. The embedded portion 64 of the shaft 60 is the remaining portion of the length. The shaft 60 has two recesses 66, 68 to promote engagement with the body 20 of the string winder on one end and with the rotation impelling means on the other end. The recesses 66, 68 may be located at almost any distance from the end. However, the distance between the recess 66, 68 and the respective end is preferably in the range of 0.1 to 1.5 inches, more preferably in the range of 0.1 and 1.25 inches, most preferably between 0.2 and 0.5 inches. The recesses 66, 68 in the embodiment shown are both approximately 0.25 inches from each end, however the recesses 66, 68 are not necessarily at the same distance from each end. The recesses 66, 68 may also vary in length depending on the design. The length of the recesses 66, 68 are preferably in the range of 0.05 to 0.5 inches, more preferably in the range of 0.08 to 0.3 inches, most preferably in the range of 0.1 to 0.25 inches. In the embodiment shown, the lower recess 66 is approximately 0.125 inches and the upper recess 68 is approximately 0.2 inches. The upper recess 68 shown is particularly useful for attachment with a cordless screwdriver, drill or the specially designed manual hand crank described later.

Figure 10A:
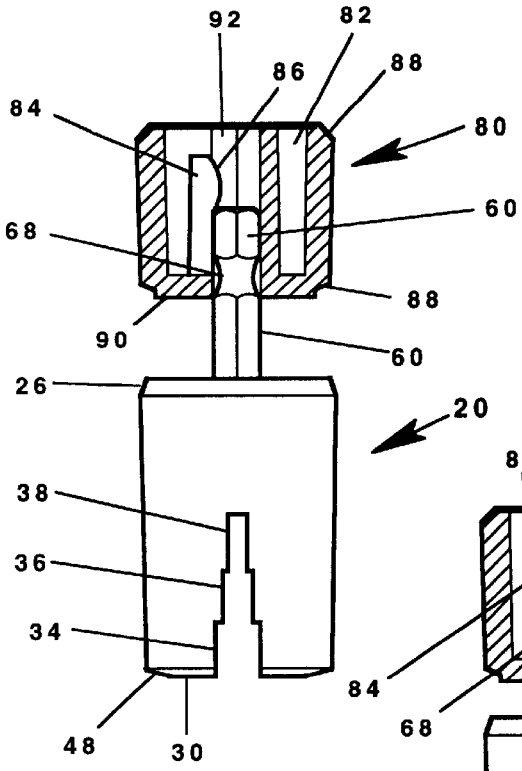
FIGS. 10A–C are side, partial cross-sectional views of the string winder as a hand crank hub is being attached.
Figure 10B:
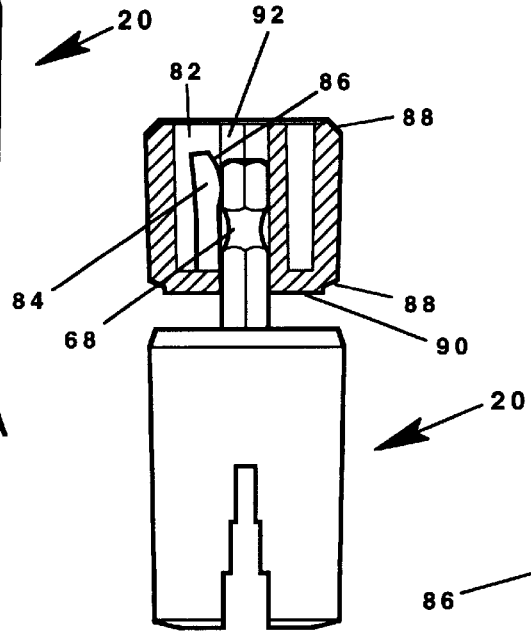
Figure 10C:
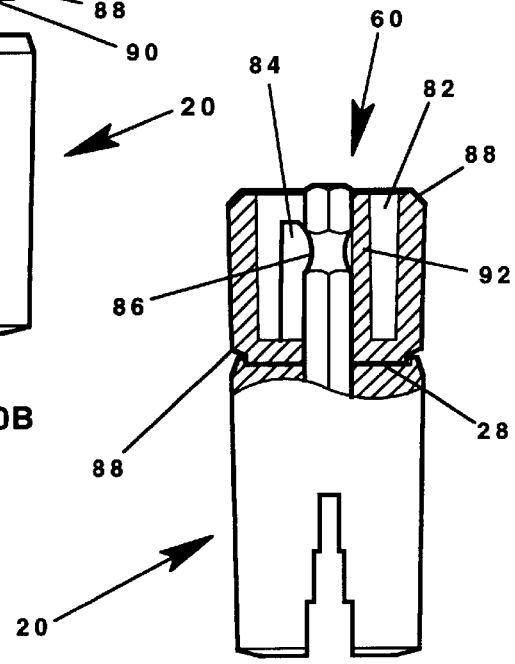

FIGS. 10A–C are side, partial cross-sectional views of the string winder 20 as a hand crank hub 80 is being attached. The hub 80 has a central hexagonal opening 92 sized to receive the hexagonal shaft 60 extending from the string winder body 20. Similar to the string winder body 20, the hand crank hub 80 has a plurality of holes 82 extending into the hub 80 to create a generally even wall thickness. The holes 82 may extend from the top of the hub 80 or from the bottom of the hub 80 or the holes 82 may alternate from the top and bottom. Alternating holes 82 are especially useful in cases where the holes 82 are tapered for ease of mold release. A flexible tab 84 may extend from within one of the holes 82 into the hexagonal opening 92. A projection 86 on the side of the tab 84 is sized and located to engage the upper recess 68 in the hexagonal shaft 60. As the hub 80 is moved downward over the hexagonal shaft 60 and the end of the shaft 80 reaches the projection 86 on the tab 84, the shaft 60 deforms the tab 84, as seen in FIG. 10B. When the hub 80 has moved into place, the projection 86 on the tab 84 aligns with the upper recess 68 in the hexagonal shaft 60 and extends therein. The bottom edge of the hub 80 has a slight projection or boss 90, which rests within the recess 28 in the string winder body 20.

When the shaft 60 of the string winder 20 is inserted into the hex-shaped opening 92 on the hub 80, the hex shapes 60, 92 index with one another to keep the string winder 20 from rotating within. The boss 90 on the hub 80 engages the recess 28 in the top end 22 of the string winder body 20, and the projection 86 on the internal tab 84 snaps into the upper shaft recess 68 thus securing the string winder 20 and hub 80 together for use.

Figure 11:
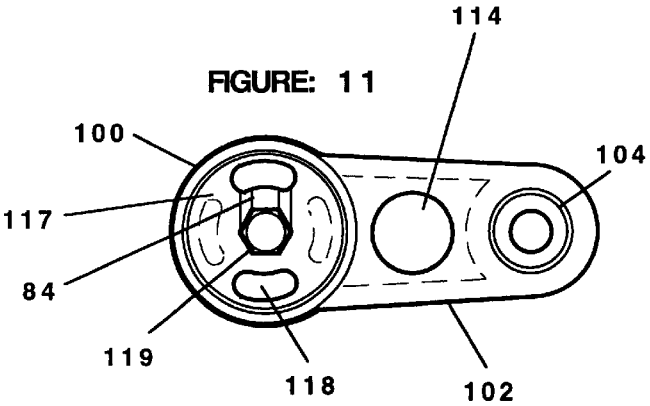
FIG. 11 is a top view of a crank handle assembly.
Figure 12:
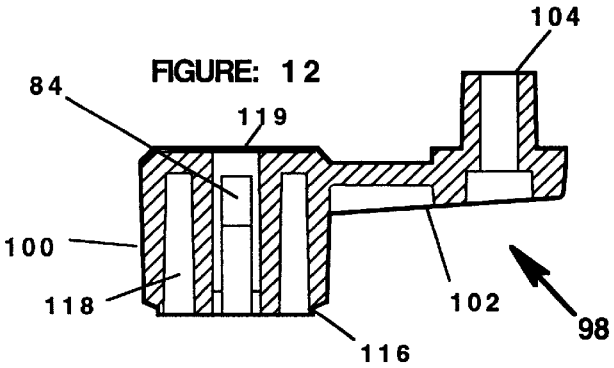
FIG. 12 is a cross-sectional view of the crank handle assembly.
Figure 13:
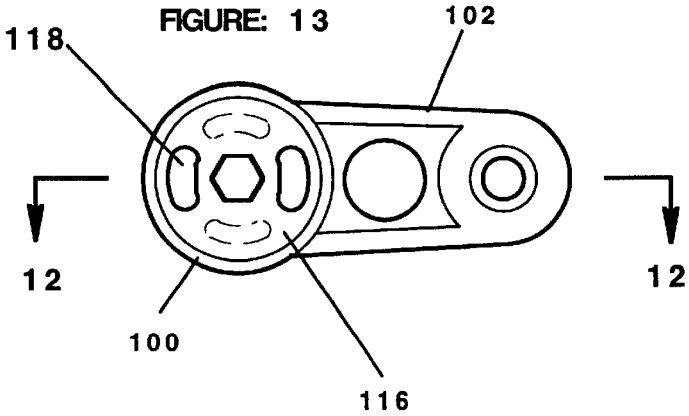
FIG. 13 is a bottom view of the crank handle assembly.
Figure 14:
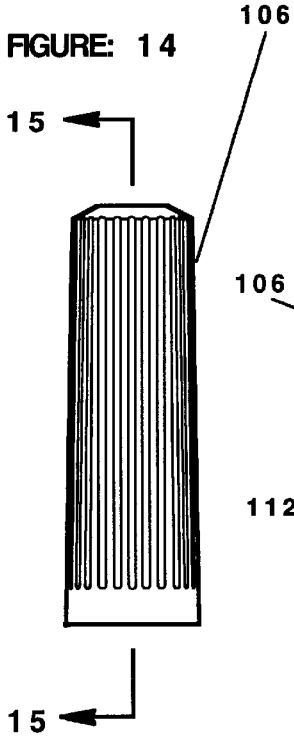
FIG. 14 is a side view of a handle.
Figure 15:
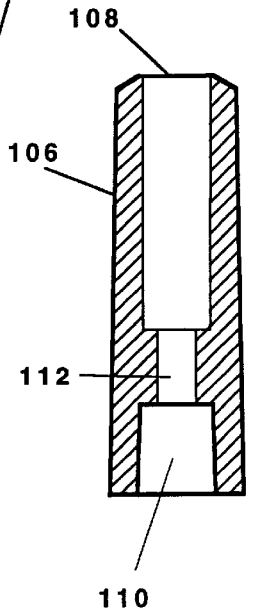
FIG. 15 is a cross-sectional view of the handle.
Figure 16:
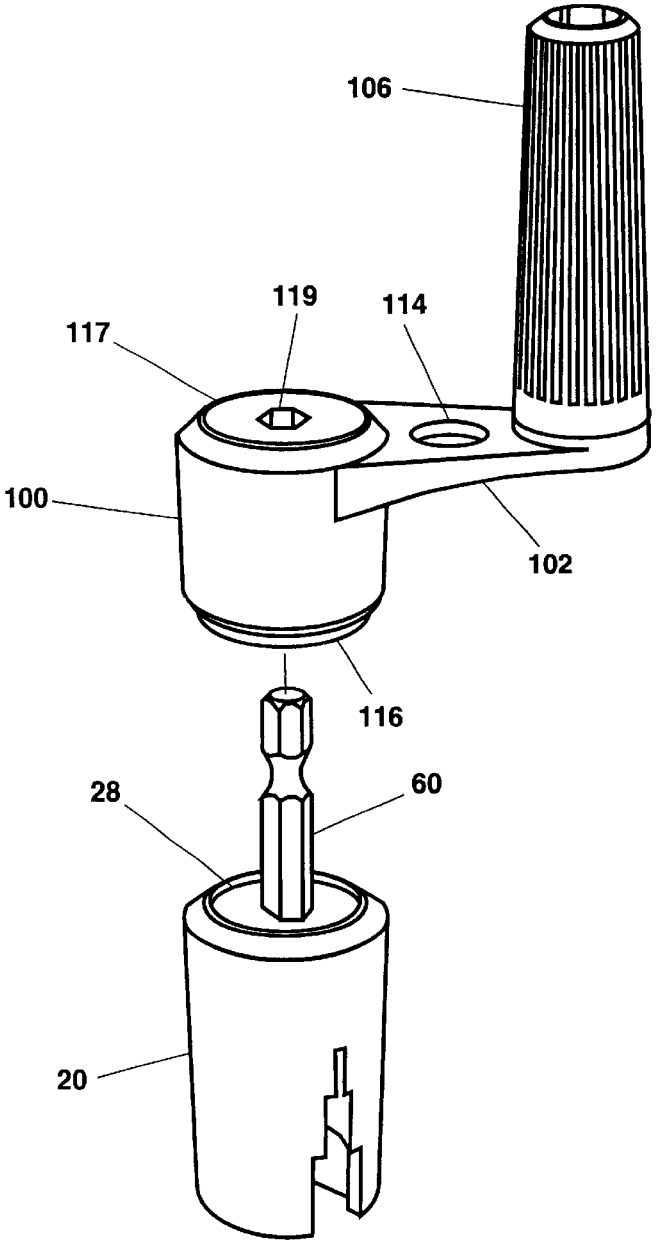
FIG. 16 is a perspective view of the string winder with the handle assembly being installed.

FIGS. 11, 12 and 13 are top, cross-sectional and bottom views of a handle assembly 98. FIGS. 14 and 15 are side and cross-sectional views of the handle 106. FIG. 16 is a perspective view of the string winder 20 with the handle assembly 98 being installed. The handle assembly 98 has three main parts: the hub 100, the lever arm 102 and the handle attachment 105. The hub 100 has a similar configuration to the hub 80 described above, including the flexible tab 84, which interlocks the string winder body 20 and the hub 100. The top of the hub 100 may have a label recess 117 similar to the recess 28 described on the string winder body 20. The lever arm 102 extends any convenient length from the hub 100, such as approximately 1.5 inches, and extends generally perpendicular to the sidewall of the hub 100. At the end of the lever arm 102, a handle attachment 104 extends upward. Although the attachment 104 may take other forms, the embodiment shown uses a mounting boss 104, which fits into an opening 110 in the lower end of a rotating handle 106. The rotating handle 106 is secured to the lever arm 102 with a large screw, which is recessed into a deep opening 108 extending down from the top of the handle 106. The screw attaches the handle 106 to the lever arm 102, but not tight enough to prevent it from rotating.

Figure 17:
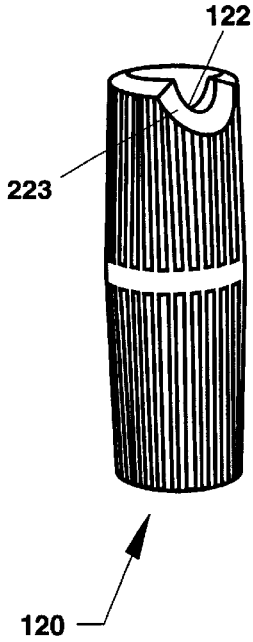
FIG. 17 is an alternate handle design.

FIG. 17 is an alternate handle 120 design with a notch 122 located in the upper perimeter of the handle 120. The notch 122 is used for removing the string retainer peg or pin on acoustic guitars. The embodiment shown is especially useful for removing the retainer pin since the flattened surface 223 below the notch 122 is angled for easier engagement with the pin.

Figure 18:
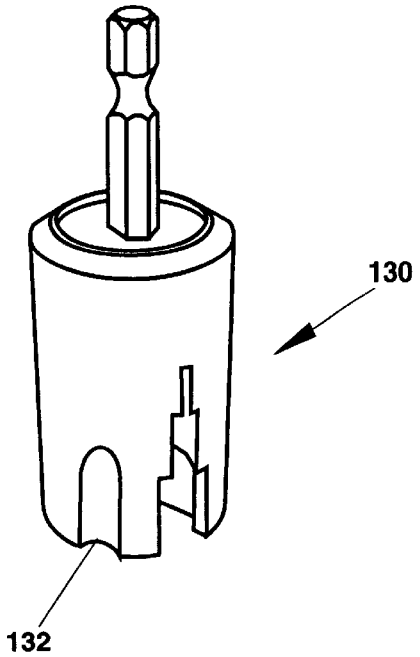
FIG. 18 is an alternate string winder body design.

FIG. 18 is an alternate string winder body 130 design with recesses 132 in the outside of the sidewall of the body 130. The recesses 132 improve the consistency of the wall thickness to improve the design for ease of molding.

The string winder 20 is operated by snapping it into a cordless screwdriver 140, drill or the accompanying manual hub 80 or hand crank 98. The bottom end 30 of the body 20 is then fit over the desired tuning peg 142 and rotated either clockwise or counter clockwise to tighten or loosen the strings. The correct section of the slot 32 automatically seeks, finds and indexes on the peg 142 thus enabling the task of changing the strings to be accomplished, if using a cordless screw driver 140, in approximately half the time of hand winding.

The string winder body 80, hub 20, handle 106, etc. may be made of virtually any material, such as metal, plastic, wood, fiberglass, etc. Preferably the parts are injection molded using any one of a variety of plastic polymer compounds. For injection molding, it may be advantageous to provide a slight taper to all of the walls, for example approximately ½ percent slope to encourage easy mold release. The hexagonal shaft 60 is preferably made of a relatively durable material, such as high-strength plastic, steel or other material.

Many features have been listed with particular configurations, options, and embodiments. Any one or more of the features described may be added to or combined with any of the other embodiments or other standard devices to create alternate combinations and embodiments.

Although the examples given include many specificities, they are intended as illustrative of only a few possible embodiments of the invention. For example, the shaft in the embodiments described is hexagonal, however, other shapes of shafts, such as square or keyed circular shafts, may also be used. The only requirement is that rotational motion between the string winder body and the object engaging the shaft be inhibited. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

We claim:

1. A string winding device for winding and unwinding a string on a peg of a stringed instrument, the string winding device comprising:

a string winder body having a top end, a bottom end, and at least one molding hole extending into said string winder body from said top end, and a slot extending into said string winder body from said bottom end, said slot configured to engage a plurality of differently-shaped musical instrument pegs, said slot having a first section having a first width and a second section having a second width, said first and second widths being different.

2. The string winding device of claim 1 wherein said first section and said second section of said slot extend to a sidewall of said string winder body, thereby creating stepped openings extending up opposite sides of said sidewall.

3. The string winding device of claim 1 wherein said string winder body is formed of plastic.

4. The string winding device of claim 1 wherein said first section of said slot has first and second walls extending generally perpendicular to said first width, said first and second walls being generally planar and forming at least a majority of a diameter of said string winder body and wherein said second section of said slot has third and fourth walls extending generally perpendicular to said second width, said third and fourth walls being generally planar and forming at least a majority of said diameter of said string winder body.

5. A string winding device for winding and unwinding a string on a peg of a stringed instrument, the string winding device comprising:

a string winder body having a top end and a bottom end, and a slot extending into said string winder body from said bottom end, said slot configured to engage a plurality of differently-shaped musical instrument pegs, said slot having a first section having a first width, a second section having a second width, and a third section having a third width, said first, second, and third widths being different, a top surface of said first section having a first curvature, said first curvature extending along a diameter of said string winder body and perpendicular to said first width, a second top surface of said third section having a second curvature, said second curvature extending along said diameter of said string winder body and perpendicular to said second width.

6. The string winding device of claim 5 wherein said slot further comprises a fourth section having a fourth width.

7. The string winding device of claim 6 wherein said fourth section is generally perpendicular to said first, second and third sections of said slot.

8. The string winding device of claim 5 wherein said first section of said slot has a width in the range of 0.15 to 0.35 inches, said second section of said slot has a width in the range of 0.10 to 0.20 inches and the third section of said slot has a width in the range of 0.08 to 0.10 inches.

9. The string winding device of claim 5 further comprising a shaft integrally formed with said string winder body, said shaft extending from a top end of said string winder body.

10. The string winding device of claim 9 wherein said shaft is hexagonal.

11. The string winding device of claim 10 further comprising a hub designed and configured to engage said hexagonal shaft.

12. The string winding device of claim 11 wherein said hub has a hexagonal, central opening sized to receive said hexagonal shaft.

13. The string winding device of claim 5 wherein said second curvature of said second top surface has a radius of curvature of from 0.2 to 0.6 inches.

14. The string winding device of claim 5 wherein said first curvature of said top surface of said first section has a radius of curvature of 0.4 to 0.8 inches.

15. A string winding device for winding and unwinding a string on a peg of a stringed instrument, the string winding device comprising:

a string winder body having a top end and a bottom end, a slot extending into said string winder body from said bottom end, said slot configured to engage a plurality of differently-shaped musical instrument pegs, said slot having a first section having a first width and a second section having a second width, said first and second widths being different, a hexagonal shaft integrally formed with said string winder body, said shaft extending from a top end of said string winder body, a hub designed and configured to engage said hexagonal shaft, and an opening extending into said hub, said opening having a flexible tab extending therein, said tab having a projection extending therefrom, said projection sized to fit within a recess in said hexagonal shaft.

16. A string winding device for winding and unwinding a string on a peg of a stringed instrument, the string winding device comprising:

a generally cylindrical string winder body having a top end and a bottom end, a slot extending into said string winder body from said bottom end, said slot having a first section having a first width, a second section having a second width, a third section having a third width and a fourth section having a fourth width, said first, second and third widths being different, wherein said first, second and third sections of said slot form a stepped opening extending up opposite sides of said string winder body, a hexagonal shaft extending from the top end of said string winder body, a hub designed and configured to engage said hexagonal shaft, an opening extending into said hub, said opening having a flexible tab extending therein, said tab having a projection extending therefrom, said projection sized to fit within a recess in said hexagonal shaft.

17. The string winding device of claim 16 wherein said fourth section is generally perpendicular to said first, second and third sections.

18. The string winding device of claim 16 wherein an upper surface of said first section has a concave recess and an upper surface of said third section has a concave recess.

19. The string winding device of claim 16 wherein said first section of said slot has a width in the range of 0.15 to 0.35 inches, said second section of said slot has a width in the range of 0.10 to 0.20 inches, said third section of said slot has a width in the range of 0.08 to 0.10 inches and said fourth section of said slot has a width in the range of 0.2 to 0.3 inches.

20. The string winding device of claim 16 further comprising a handle assembly for turning said string winder body, said handle assembly having a hub designed and configured to engage said hexagonal shaft, a lever arm extending from said hub and a handle attached to said lever arm.

21. A string winding device for winding and unwinding a string on a peg of a stringed instrument, the string winding device comprising:

a generally cylindrical, string winder body having a top end and a bottom end, a slot extending into said string winder body from said bottom end, said slot having a first section having a first width, a second section having a second width, a third section having a third width and a fourth section having a fourth width, said first, second and third widths being different, wherein said first, second and third sections of said slot form a stepped opening extending up opposite sides of said string winder body, a hexagonal shaft extending from the top end of said string winder body, and a handle assembly for turning said string winder body, said handle assembly having a hub designed and configured to engage said hexagonal shaft, a lever arm extending from said hub and a handle attached to said lever arm, said handle having an angled notch cut in an upper end thereof.

* * * * *